US005919105A

United States Patent [19]

Summers

[11] Patent Number: 5,919,105

[45] Date of Patent: Jul. 6, 1999

[54] ARROW NOCK SYSTEM

[76] Inventor: Daniel A. Summers, 84 Brandywine Dr., Madison Heights, Va. 24572

[21] Appl. No.: 09/007,920

[22] Filed: Jan. 16, 1998

[51] Int. Cl.[6] ..... F42B 6/06

[52] U.S. Cl. ..... 473/578

[58] Field of Search ..... 124/91; 473/578, 473/586, FOR 216, FOR 223

[56] References Cited

U.S. PATENT DOCUMENTS

| | | | |
|---|---|---|---|
| 3,010,446 | 11/1961 | Frantello | 124/35.2 X |
| 4,874,180 | 10/1989 | Fingerson et al. | 473/578 |
| 5,154,432 | 10/1992 | Saunders | 473/578 |
| 5,361,747 | 11/1994 | Laabs | 124/91 |

*Primary Examiner*—John A. Ricci

[57] ABSTRACT

An arrow nock system for use with an arrow. The arrow may include cylindrical shaft with a frusto-conical projection at the rear. A butt piece with a complementary frusto-conical interior bore is secured to the projection. The butt piece includes a proximal half, closer to the arrow, with a cylindrical outer surface equal to the diameter of the arrow shaft, and a distal half with a frusto-conical outer surface. Near the outer end of the distal half is an annular indentation. A nock piece includes a frusto-conical interior bore complementary with the distal half of the butt piece. The bore includes an annular protrusion engageable with the indentation in a rotatable snap-fit. The nock includes a cylindrical outer surface, and a groove at the rear to receive a string of a bow.

8 Claims, 2 Drawing Sheets

FIG 1
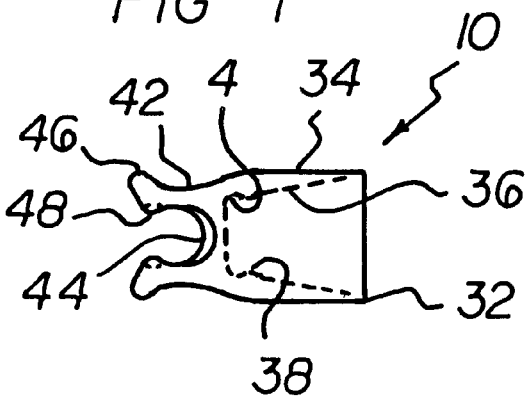
FIG 2
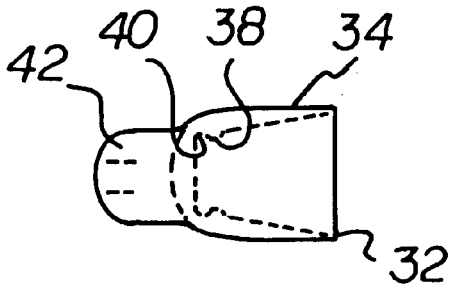
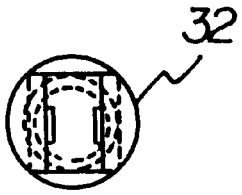
FIG 3
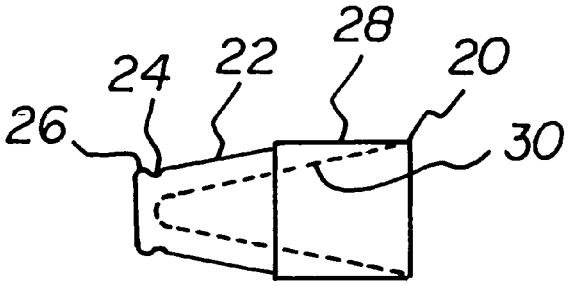
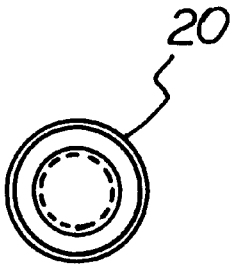
FIG 4
FIG 5

FIG 6
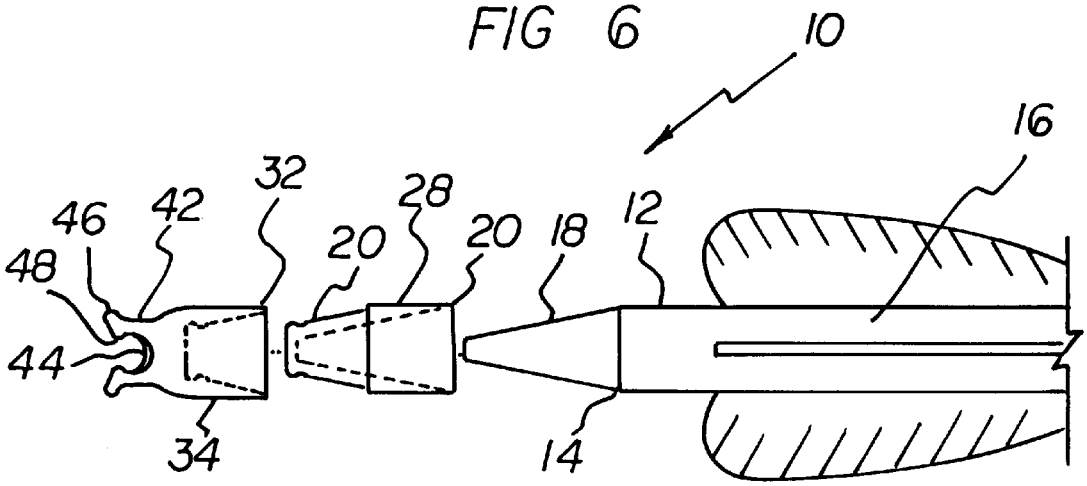
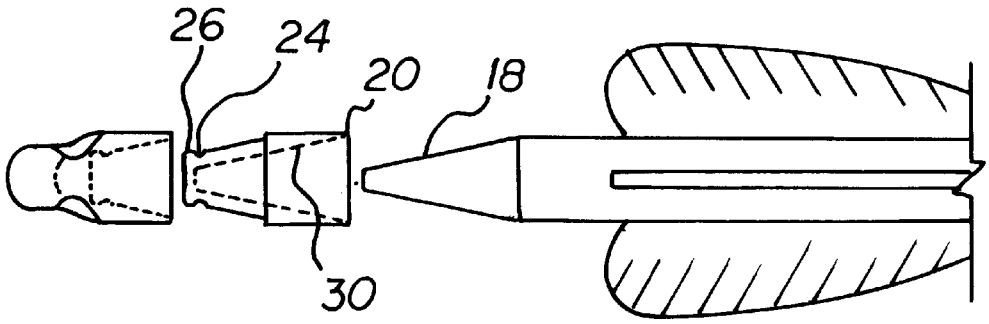
FIG 7

ARROW NOCK SYSTEM

BACKGROUND OF THE INVENTION

1. Field of the Invention

The present invention relates to an arrow nock system and more particularly pertains to such a system which is for use in conjunction with a bow string nock.

2. Description of the Prior Art

The use of bow nocks is known in the prior art. More specifically, such bow nocks are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,537,986 to Summers discloses one such bow nock device; U.S. Pat. No. 4,981,128 to Garvison discloses an arrow release device; U.S. Pat. No. 2,905,166 to Niemeyer discloses a bow string nock; U.S. Pat. No. 4,930,485 to Kopper discloses an archery bow system;lastly, U.S. Pat. No. 5,499,620 to Summers discloses a center nock for an archery bow string.

In this respect, the arrow nock of the present invention substantially departs from the conventional concepts and designs of the prior art, and in so doing provides an apparatus primarily developed for the purpose of operating in conjunction with a bow string nock.

Therefore, it can be appreciated that there exists a continuing need for improvements in nock devices. In this regard, the present invention substantially fulfills this need.

SUMMARY OF THE INVENTION

In view of the foregoing disadvantages inherent in the known types of archery nocks now present in the prior art, the present invention provides an arrow nock system. As such, the general purpose of the present invention, which will be described subsequently in greater detail, is to provide an arrow nock which is specifically for use with a bow string nock.

To attain this, the present invention essentially comprises an arrow shaft with a cylindrical configuration. As shown in FIGS. 6 & 7, the arrow shaft is equipped with a distal end, a proximal end and an intermediate extent therebetween. The proximal end has a frusto-conical protrusion formed thereon in coaxial relationship therewith. It should be noted that a diameter of a base of the protrusion is equal to that of the shaft. Next provided is a butt piece having a length approximately equal to that of the protrusion of the arrow shaft. The butt piece has a distal half having an outer surface with a frusto-conical configuration. An annular indentation is formed in the outer surface of the distal half. Such annular indentation resides adjacent to a distal end of the distal half and in concentric relationship therewith, as shown in FIGS. 4 & 5. An annular protrusion is also formed on the outer surface of the distal half of the butt piece and extending radially outward therefrom. The annular protrusion resides between the annular indentation and the distal end of the distal half. The butt piece further includes a proximal half having an outer surface with a cylindrical configuration and a diameter equal to that of the arrow shaft. The distal and proximal halves, together, have an interior bore with a frusto conical configuration formed therein in concentric relationship therewith. A base of the interior bore is coincident with a proximal end of the proximal half for fixedly receiving the protrusion of the arrow shaft. FIGS. 1–3 show an arrow nock having a proximal half with an outer surface with a cylindrical configuration. A diameter of the outer surface of the proximal half is equal to that of the arrow shaft. The proximal half of the arrow nock further has an opening formed in a proximal end thereof with a frusto-conical configuration situated in concentric relationship therewith. For reasons that will soon become apparent, an annular protrusion is formed in an inner surface of the opening adjacent to a distal end of the proximal half of the arrow nock and in concentric relationship therewith. The annular protrusion extends radially inward. Associated therewith is an annular indentation formed in the inner surface of the opening between the annular protrusion of the arrow nock and the distal end of the proximal half of the arrow nock. The arrow nock further includes a pair of ears each having a proximal end mounted to diametrically opposed sides of the distal end of the proximal half of the arrow nock. The ears define a groove adapted to releasably receive a string of a bow. Each ear has a length equal to that of the proximal half of the arrow nock. Further, the ears each include a radially extending lip coupled to a distal end thereof. Note FIG. 1. Also shown in such Figure is an inwardly extending protrusion formed in an inner surface of the ear at the distal end thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved arrow nock which is removably secured to the rearward end of an archery arrow.

It is another object of the present invention to provide an arrow nock system which enables various sized nocks to be employed upon a single arrow.

It is a further object of the present invention to provide an arrow nock which is dimensioned to be employed in conjunction with a bow string nock.

An even further object of the present invention is to provide an arrow nock system which is susceptible of a low cost of manufacture with regard to both materials and labor, and which accordingly is then susceptible of low prices of sale to the consuming public, thereby making such arrow nocks economically available to the buying public.

Still another object of the present invention is to create a nock system which increases the ease and efficiency of both drawing and releasing a bow string.

Lastly, it is an object of the present invention to provide a new and improved arrow nock system that includes an arrow shaft. Also included is an arrow nock defining a groove adapted to releasably receive a string of a bow. The arrow nock is further rotatably coupled with respect to the shaft. The groove of the arrow nock may thus be rotated about an axis about which the arrow shaft resides.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of the arrow nock of the present invention.

FIG. 2 is a top view of the arrow nock of the present invention.

FIG. 3 is an end view of the arrow nock of the present invention.

FIG. 4 is a side view of the butt piece of the present invention.

FIG. 5 is an end view of the butt piece of the present invention.

FIG. 6 is a side view of the present invention during use.

FIG. 7 is a top view of the present invention during use.

Similar reference characters refer to similar parts throughout the several views of the drawings.

DESCRIPTION OF THE PREFERRED EMBODIMENT

The present invention relates to an arrow nock system. The system, which is secured to the end of an arrow, ensures proper placement of the bowstring with respect to the arrow. Additionally, the arrow nock of the present invention is specifically dimensioned for use in conjunction with a C-shaped bow string nock. Such bow string nocks are secured along the length of a bowstring to facilitate proper drawing and firing.

The system 10 of the present invention includes an arrow shaft 12 with a cylindrical configuration. As shown in FIGS. 6 & 7, the arrow shaft is equipped with a distal end, a proximal end 14 and an intermediate extent 16 therebetween. The proximal end has a frusto-conical protrusion 16 formed thereon in coaxial relationship therewith. It should be noted that a diameter of a base of the protrusion is equal to that of the shaft.

Next provided is a butt piece 20 having a length approximately equal to that of the protrusion of the arrow shaft. The butt piece has a distal half 22 having an outer surface with a frusto-conical configuration. An annular indentation 24 is formed in the outer surface of the distal half. Such annular indentation resides adjacent to a distal end of the distal half and in concentric relationship therewith, as shown in FIGS. 4 & 5. An annular protrusion 26 is also formed on the outer surface of the distal half of the butt piece and extends radially outward therefrom. The annular protrusion resides between the annular indentation and the distal end of the distal half. In the preferred embodiment, the annular protrusion and indentation are in side-by-side relationship.

The butt piece further includes a proximal half 28 having an outer surface with a cylindrical configuration and a diameter equal to that of the arrow shaft. It should be noted that the diameter of a base of the frusto-conical protrusion of the distal half of the butt piece is less than the diameter of the proximal half. The distal and proximal halves, together, have an interior bore 30 with a frusto conical configuration formed therein in concentric relationship therewith. A base of the interior bore is coincident with a proximal end of the proximal half for fixedly receiving the protrusion of the arrow shaft. Such securement is preferably accomplished by way of an adhesive or the like.

FIGS. 1–3 show an arrow nock 32 having a proximal half 34 with an outer surface with a cylindrical configuration. A diameter of the outer surface of the proximal half is equal to that of the arrow shaft. The proximal half of the arrow nock further has an opening 36 formed in a proximal end thereof with a frusto-conical configuration situated in concentric relationship therewith. For reasons that will soon become apparent, an annular protrusion 38 is formed in an inner surface of the opening adjacent to a distal end of the proximal half of the arrow nock and in concentric relationship therewith. The annular protrusion extends radially inward. Associated therewith is an annular indentation 40 formed in the inner surface of the opening between the annular protrusion of the arrow nock and the distal end of the proximal half of the arrow nock.

The arrow nock further includes a pair of ears 42 each having a proximal end mounted to diametrically opposed sides of the distal end of the proximal half of the arrow nock. The ears define a groove 44 adapted to releasably receive a string of a bow. Each ear preferably has a length equal to that of the proximal half of the arrow nock. Such length renders the present invention ideally tailored to be used in conjunction with a C-shaped bow string nock like that described in U.S. Pat. No. 5,537,986 to Summers, incorporated herein by reference. It should be noted, however, that the length may be selectively lengthened, as desired.

Further, the ears each include a radially extending lip 46 coupled to a distal end thereof. Note FIG. 1. The lips preferably have rounded corners and a width and thickness similar to those of the remaining portion of the ear. Also shown in FIG. 1 is an inwardly extending ellipsoidal protrusion 48 formed in an inner surface of each ear at the distal end thereof. The ellipsoidal protrusions each extend along a width of the associated ear.

By such structure, the opening of the proximal half of the arrow nock is adapted to snappily and rotatably receive the distal half of the butt piece. Such feature is critical for allowing the groove to be rotated about an axis associated with the arrow shaft such that fins of the arrow may be selectively aligned. When coupled, the butt piece and arrow nock define a continuous cylindrical outer surface. Further, the coupling of the butt piece and arrow nock permits the nock to be selectively replaced or modified.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An arrow nock system comprising in combination:

an arrow shaft with a cylindrical configuration and having a distal end, a proximal end and an intermediate extent therebetween, the proximal end having a frusto-conical protrusion formed thereon in coaxial relationship therewith, wherein a diameter of a base of the protrusion is equal to that of the shaft;

a butt piece having a length approximately equal to that of the protrusion of the arrow shaft, the butt piece having a distal half having an outer surface with a frusto-conical configuration, an annular indentation formed in the outer surface of the distal half adjacent to a distal end of the distal half and in concentric relationship therewith, and an annular protrusion formed on the outer surface of the distal half between the annular indentation and the distal end of the distal half, the butt piece further including a proximal half having an outer surface with a cylindrical configuration having a diameter equal to that of the arrow shaft, the distal and proximal halves having an interior bore with a frusto conical configuration formed therein in concentric relationship therewith, wherein a base of the interior bore is coincident with a proximal end of the proximal half for being fixedly secured to the protrusion of the arrow shaft; and an arrow nock having a proximal half with an outer surface with a cylindrical configuration having a diameter equal to that of the arrow shaft, the proximal half of the arrow nock further having an opening formed in a proximal end thereof with a frusto-conical configuration situated in concentric relationship therewith, an annular protrusion formed in an inner surface of the opening adjacent to a distal end of the proximal half of the arrow nock and in concentric relationship therewith, and an annular indentation formed in the inner surface of the opening between the annular protrusion of the arrow nock and the distal end of the proximal half of the arrow nock, wherein the annular protrusion of the arrow nock extends radially inward such that the opening of the proximal half of the arrow nock is adapted to snappily and rotatably receive the distal half of the butt piece, the arrow nock further including a pair of ears each having a proximal end mounted to diametrically opposed sides of the distal end of the proximal half of the arrow nock for defining a groove adapted to releasably receive a string of a bow, each ear having a length equal to that of the proximal half of the arrow nock and including a radially extending lip coupled to a distal end thereof and a inwardly extending protrusion formed in an inner surface of the ear at the distal end thereof.

2. An arrow nock system comprising:

an arrow shaft; and an arrow nock defining a groove adapted to releasably receive a string of a bow, the arrow nock being rotatably coupled with respect to the shaft, wherein the groove of the arrow nock may be rotated about an axis about which the arrow shaft resides;

wherein a butt piece is fixedly secured to the arrow shaft and the arrow nock is rotatable coupled to the butt piece;

wherein the arrow nock is releasably coupled to the butt piece via a snap coupling.

3. An arrow nock system as set forth in claim 2 wherein the butt piece and arrow nock each have a common length.

4. An arrow nock system as set forth in claim 2 wherein the snap coupling includes a protrusion and bore combination, wherein at least one of protrusion and bore has an annular indentation formed therein.

5. An arrow nock system as set forth in claim 2 wherein the arrow nock includes a pair of ears for defining the groove.

6. An arrow nock system as set forth in claim 5 wherein the ears each have a protrusion extending inwardly from an inner surface thereof for engaging the string.

7. An arrow nock system as set forth in claim 5 wherein the ears each have an outwardly extending lip.

8. An arrow nock system comprising:

an arrow shaft; and an arrow nock defining a groove adapted to releasably receive a string of a bow;

wherein a butt piece is fixedly secured to the arrow shaft at a tapered interface and the arrow nock is releasably coupled to the butt piece via a snap coupling.

* * * * *